US007744164B2

(12) United States Patent
Hall et al.

(10) Patent No.: US 7,744,164 B2
(45) **Date of Patent: *Jun. 29, 2010**

(54) SHIELD OF A DEGRADATION ASSEMBLY

(75) Inventors: David R. Hall, Provo, UT (US); Ronald Crockett, Payson, UT (US); Scott Dahlgren, Alpine, UT (US)

(73) Assignee: Schluimberger Technology Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/177,599

(22) Filed: Jul. 22, 2008

(65) Prior Publication Data

US 2008/0309147 A1 Dec. 18, 2008

Related U.S. Application Data

(63) Continuation of application No. 12/177,556, filed on Jul. 22, 2008, now Pat. No. 7,635,168, which is a continuation-in-part of application No. 12/135,595, filed on Jun. 9, 2008, which is a continuation-in-part of (Continued)

(51) Int. Cl.
*E21C 35/18* (2006.01)

(52) U.S. Cl. ..... 299/104

(58) Field of Classification Search ..... 299/104, 299/113, 111, 106, 107

See application file for complete search history.

(56) References Cited

U.S. PATENT DOCUMENTS 1,899,343 A * 2/1933 Mackey et al. ..... 29/439

(Continued)

*Primary Examiner*—John Kreck
(74) *Attorney, Agent, or Firm*—Holme Roberts & Owen LLP

(57) ABSTRACT

In one aspect of the present invention, a degradation assembly comprises a shank with a forward end and a rearward end, the rearward end being adapted for attachment to a driving mechanism, with a shield rotatably attached to the forward end of the shank. The shield comprises an underside adapted for rotatable attachment to the shank and an impact tip disposed on an end opposing the underside. A seal is disposed intermediate the shield and the shank.

20 Claims, 6 Drawing Sheets

Related U.S. Application Data

(63) application No. 12/112,743, filed on Apr. 30, 2008, which is a continuation-in-part of application No. 12/051,738, filed on Mar. 19, 2008, which is a continuation-in-part of application No. 12/051,689, filed on Mar. 19, 2008, which is a continuation of application No. 12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 12/135,595 and a continuation-in-part of application No. 11/695,672, filed on Apr. 3, 2007, now Pat. No. 7,396,086, is a continuation-in-part of application No. 11/686,831, filed on Mar. 15, 2007, now Pat. No. 7,568,770.

(56) References Cited

U.S. PATENT DOCUMENTS

| | | | | |
|---|---|---|---|---|
| 2,004,315 | A | | 6/1935 | Fean |
| 2,124,438 | A | | 7/1938 | Struk |
| 3,254,392 | A | | 7/1966 | Novkov |
| 3,342,531 | A | * | 9/1967 | Krekeler ..... 299/107 |
| 3,397,012 | A | * | 8/1968 | Krekeler ..... 299/104 |
| 3,746,396 | A | | 7/1973 | Radd |
| 3,807,804 | A | | 4/1974 | Kniff |
| 3,830,321 | A | | 8/1974 | McKenry |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,098,362 | A | | 7/1978 | Bonnice |
| 4,109,737 | A | | 8/1978 | Bovenkerk |
| 4,156,329 | A | | 5/1979 | Daniels et al. |
| 4,199,035 | A | | 4/1980 | Thompson |
| 4,201,421 | A | | 5/1980 | Den Besten |
| 4,277,106 | A | | 7/1981 | Sahley |
| 4,439,250 | A | | 3/1984 | Acharya et al. |
| 4,465,221 | A | | 8/1984 | Schmidt |
| 4,484,644 | A | | 11/1984 | Cook |
| 4,489,986 | A | | 12/1984 | Dziak |
| 4,678,237 | A | | 7/1987 | Collin |
| 4,682,987 | A | | 7/1987 | Brady |
| 4,688,856 | A | | 8/1987 | Elfgen |
| 4,720,199 | A | * | 1/1988 | Geczy et al. ..... 384/282 |
| 4,725,098 | A | | 2/1988 | Beach |
| 4,729,603 | A | | 3/1988 | Elfgen |
| 4,765,686 | A | | 8/1988 | Adams |
| 4,765,687 | A | | 8/1988 | Parrott |
| 4,776,862 | A | | 10/1988 | Wiand |
| 4,880,154 | A | | 11/1989 | Tank |
| 4,932,723 | A | | 6/1990 | Mills |
| 4,934,467 | A | * | 6/1990 | Langford, Jr. ..... 175/371 |
| 4,940,288 | A | | 7/1990 | Stiffler |
| 4,944,559 | A | | 7/1990 | Sionnet |
| 4,951,762 | A | | 8/1990 | Lundell |
| 5,011,515 | A | | 4/1991 | Frushour |
| 5,112,165 | A | | 5/1992 | Hedlund |
| 5,141,289 | A | | 8/1992 | Stiffler |
| 5,154,245 | A | | 10/1992 | Waldenstrom |
| 5,188,892 | A | | 2/1993 | Grindstaff |
| 5,251,964 | A | | 10/1993 | Ojanen |
| 5,261,499 | A | | 11/1993 | Grubb |
| 5,332,348 | A | | 7/1994 | Lemelson |
| 5,417,475 | A | | 5/1995 | Graham |
| 5,447,208 | A | | 9/1995 | Lund |
| 5,535,839 | A | | 7/1996 | Brady |
| 5,542,993 | A | | 8/1996 | Rabinkin |
| 5,653,300 | A | | 8/1997 | Lund |
| 5,738,698 | A | | 4/1998 | Kapoor |
| 5,823,632 | A | | 10/1998 | Burkett |
| 5,837,071 | A | | 11/1998 | Andersson |
| 5,845,547 | A | | 12/1998 | Sollami |
| 5,875,862 | A | | 3/1999 | Jurewicz |
| 5,934,542 | A | | 8/1999 | Nakamura |
| 5,935,718 | A | | 8/1999 | Demo |
| 5,944,129 | A | | 8/1999 | Jensen |
| 5,967,250 | A | | 10/1999 | Lund |
| 5,992,405 | A | | 11/1999 | Sollami |
| 6,006,846 | A | | 12/1999 | Tibbitts |
| 6,019,434 | A | | 2/2000 | Emmerich |
| 6,044,920 | A | | 4/2000 | Massa |
| 6,051,079 | A | | 4/2000 | Andersson |
| 6,056,911 | A | | 5/2000 | Griffin |
| 6,065,552 | A | | 5/2000 | Scott et al. |
| 6,113,195 | A | | 9/2000 | Mercier |
| 6,170,917 | B1 | | 1/2001 | Heinrich |
| 6,193,770 | B1 | | 2/2001 | Sung |
| 6,196,636 | B1 | | 3/2001 | Mills |
| 6,196,910 | B1 | | 3/2001 | Johnson |
| 6,199,956 | B1 | | 3/2001 | Kammerer |
| 6,216,805 | B1 | | 4/2001 | Lays |
| 6,270,165 | B1 | | 8/2001 | Peay |
| 6,341,823 | B1 | | 1/2002 | Sollami |
| 6,354,771 | B1 | | 3/2002 | Bauschulte |
| 6,364,420 | B1 | | 4/2002 | Sollami |
| 6,371,567 | B1 | | 4/2002 | Sollami |
| 6,375,272 | B1 | | 4/2002 | Ojanen |
| 6,419,278 | B1 | | 7/2002 | Cunningham |
| 6,478,383 | B1 | | 11/2002 | Ojanen |
| 6,499,547 | B2 | | 12/2002 | Scott |
| 6,517,902 | B2 | | 2/2003 | Drake |
| 6,585,326 | B2 | | 7/2003 | Sollami |
| 6,685,273 | B1 | | 2/2004 | Sollami |
| 6,692,083 | B2 | | 2/2004 | Latham |
| 6,709,065 | B2 | | 3/2004 | Peay |
| 6,719,074 | B2 | | 4/2004 | Tsuda |
| 6,733,087 | B2 | * | 5/2004 | Hall et al. ..... 299/113 |
| 6,739,327 | B2 | | 5/2004 | Sollami |
| 6,758,530 | B2 | | 7/2004 | Sollami |
| 6,786,557 | B2 | | 9/2004 | Montgomery, Jr. |

6,824,225 B2 11/2004 Stiffler
6,846,045 B2 * 1/2005 Sollami ..... 299/105
6,851,758 B2 2/2005 Beach
6,854,810 B2 2/2005 Montgomery, Jr.
6,861,137 B2 3/2005 Hughes
6,889,890 B2 5/2005 Yamazaki
6,966,611 B1 11/2005 Sollami
6,994,404 B1 2/2006 Sollami
7,204,560 B2 4/2007 Mercier
2002/0175555 A1 11/2002 Mercier
2003/0140360 A1 7/2003 Mansuy et al.
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

* cited by examiner

SHIELD OF A DEGRADATION ASSEMBLY

CROSS REFERENCE TO RELATED APPLICATIONS

This application is a continuation of U.S. patent application Ser. No. 12/177,556 filed Jul. 22, 2008 now U.S. Pat. No. 7,635,168 which is a continuation-in-part of U.S. patent application Ser. No. 12/135,595 filed Jun. 9, 2008 which is a continuation-in-part of U.S. patent Ser. No. 12/112,743 filed Apr. 30, 2008 which is a continuation-in-part of U.S. patent application Ser. No. 12/051,738 filed Mar. 19, 2008 which is a continuation-in-part of U.S. patent application Ser. No. 12/051,689 filed Mar. 19, 2008 which is a continuation of U.S. patent application Ser. No. 12/051,586 filed Mar. 19, 2008 which is a continuation-in-part of U.S. patent application Ser. No. 12/021,051 filed Jan. 28, 2008 which is a continuation-in-part of U.S. patent application Ser. No. 12/021,019 filed Jan. 28, 2008 which was a continuation-in-part of U.S. patent application Ser. No. 11/971,965 filed Jan. 10, 2008 now U.S. Pat. No. 7,648,210 which is a continuation of U.S. patent application Ser. No. 11/947,644, filed Nov. 29, 2007 which was a continuation-in-part of U.S. patent application Ser. No. 11/844,586. filed Aug. 24, 2007 now U.S. Pat. No. 7,600,823 U.S. patent application Ser. No. 11/844,586 is a continuation-in-part of U.S. patent application Ser. No. 11/829,761. filed Jul. 27, 2007 U.S. patent application Ser. No. 11/829,761 is a continuation-in-part of U.S. patent application Ser. No. 11/773,271. filed Jul. 3, 2007 U.S. patent application Ser. No. 11/773,271 is a continuation-in-part of U.S. patent application Ser. No. 11/766,903. filed Jun. 22, 2007 U.S. patent application Ser. No. 11/766,903 is a continuation of U.S. patent application Ser. No. 11/766,865. filed Jun. 22, 2007 U.S. patent application Ser. No. 11/766,865 is a continuation-in-part of U.S. patent application Ser. No. 11/742,304. filed Apr. 30, 2007 now U.S. Pat. No. 7,475,948 U.S. patent application Ser. No. 11/742,304 is a continuation of U.S. patent application Ser. No. 11/742,261. filed Apr. 30, 2007 now U.S. Pat. No. 7,469,971 U.S. patent application Ser. No. 11/742,261 is a continuation-in-part of U.S. patent application Ser. No. 11/464,008. filed Aug. 11, 2006 now U.S. Pat. No. 7,338,135 U.S. patent application Ser. No. 11/464,008 is a continuation-in-part of U.S. patent application Ser. No. 11/463,998. filed Aug. 11, 2006 now U.S. Pat. No. 7,384,105 U.S. patent application Ser. No. 11/463,998 is a continuation-in-part of U.S. patent application Ser. No. 11/463,990. filed Aug. 11, 2006 now U.S. Pat. No. 7,320,505 U.S. patent application Ser. No. 11/463,990 is a continuation-in-part of U.S. patent application Ser. No. 11/463,975. filed Aug. 11, 2006 now U.S. Pat. No. 7,445,294 U.S. patent application Ser. No. 11/463,975 is a continuation-in-part of U.S. patent application Ser. No. 11/463,962. filed Aug. 11, 2006 now U.S. Pat. No. 7,413,256 U.S. patent application Ser. No. 11/463,962 is a continuation-in-part of U.S. patent application Ser. No. 11/463,953. filed Aug. 11, 2006 now U.S. Pat. No. 7,464,993 The present application is also a continuation-in-part of U.S. patent application Ser. No. 11/695,672. filed Apr. 3, 2007 now U.S. Pat. No. 7,396,086 U.S. patent application Ser. No. 11/695,672 is a continuation-in-part of U.S. patent application Ser. No. 11/686,831. filed Mar. 15, 2007 now U.S. Pat. No. 7,568,770 All of these applications are herein incorporated by reference for all that they contain.

BACKGROUND OF THE INVENTION

Formation degradation, such as pavement milling, mining, drilling and/or excavating, may be performed using degradation assemblies. In normal use, these assemblies and auxiliary equipment are subjected to high impact, heat, abrasion and other environmental factors that wear their mechanical components. Many efforts have been made to improve the service life of these assemblies, including efforts to optimize the method of attachment to the driving mechanism.

One such method is disclosed in U.S. Pat. No. 5,261,499 to Grubb, which is herein incorporated by reference for all that it contains. Grubb discloses a two-piece rotatable cutting bit which comprises a shank and a nose. The shank has an axially forwardly projecting protrusion which carries a resilient spring clip. The protrusion and spring clip are received within a recess in the nose to rotatable attach the nose to the shank.

BRIEF SUMMARY OF THE INVENTION

In one aspect of the present invention, a degradation assembly comprises a shank with a forward end and a rearward end, the rearward end being adapted for attachment to a driving mechanism, with a shield rotatably attached to the forward end of the shank. The shield comprises an underside adapted for rotatable attachment to the shank and an impact tip disposed on an end opposing the underside. A seal is disposed intermediate the shield and the shank.

The shank may be attached to the holder by a press fit, threads, or other methods. The forward end of the shank may comprise one or more bearing surfaces which may be substantially cylindrical, substantially conical, or combinations thereof. The one or more bearing surfaces may comprise at least two bearing surfaces with different diameters. The one or more bearing surfaces may comprise a wear-resistant material. The bearing surface may be lubricated by a port formed in the shank in fluid communication with a fluid supply. A shield is rotatably connected to the forward end of the shank with an expandable spring clip, a snap ring, or other methods. A seal is disposed intermediate the shank and the shield and may comprise an o-ring or a radial shaft seal.

The shield may comprise an underside adapted for rotatable attachment to the forward end of the shank and an impact tip affixed on an end opposite the underside. A carbide bolster may be disposed intermediate the impact tip and a steel portion of the shield. The carbide bolster may comprise a recess armed at an interface with the steel portion of the shield. The carbide bolster may also comprise a first and second segment brazed together, and the segments may form at least a part of a cavity. One end of a shaft may be interlocked in the cavity, with an opposite end of the shaft adapted to be connected to the steel portion of the shield. The impact tip may comprise polycrystalline diamond or other super hard material bonded to a carbide substrate.

DETAILED DESCRIPTION OF THE INVENTION AND THE PREFERRED EMBODIMENT

Figure 1:
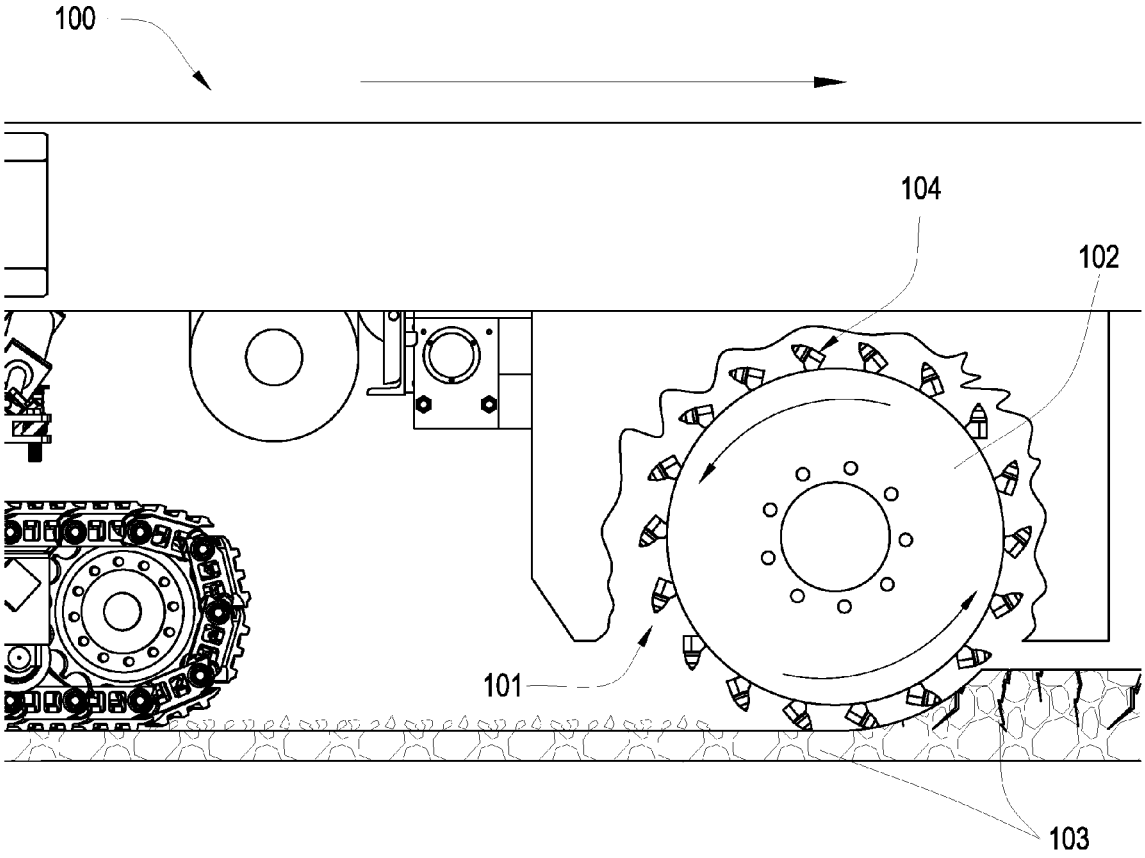
FIG. 1 is a cross-sectional diagram of an embodiment of a pavement milling machine.

FIG. 1 is a cross-sectional diagram that shows a plurality of degradation assemblies 101 attached to a driving mechanism 102, such as a rotatable drum attached to the underside of a pavement milling machine 100. The milling machine 100 may be an asphalt planer used to degrade manmade formations such as pavement 103 prior to placement of a new layer of pavement. The degradation assemblies 101 may be attached to the drum 102, bringing the degradation assemblies 101 into engagement with the formation 103. A holder 104, such as a block welded or bolted to the drum, is attached to the driving mechanism 102 and the degradation assembly is inserted into the holder. The holder 104 may hold the degradation assembly 101 at an angle offset from the direction of rotation, such that the degradation assembly engages the formation 103 at a preferential angle.

Figure 1A:
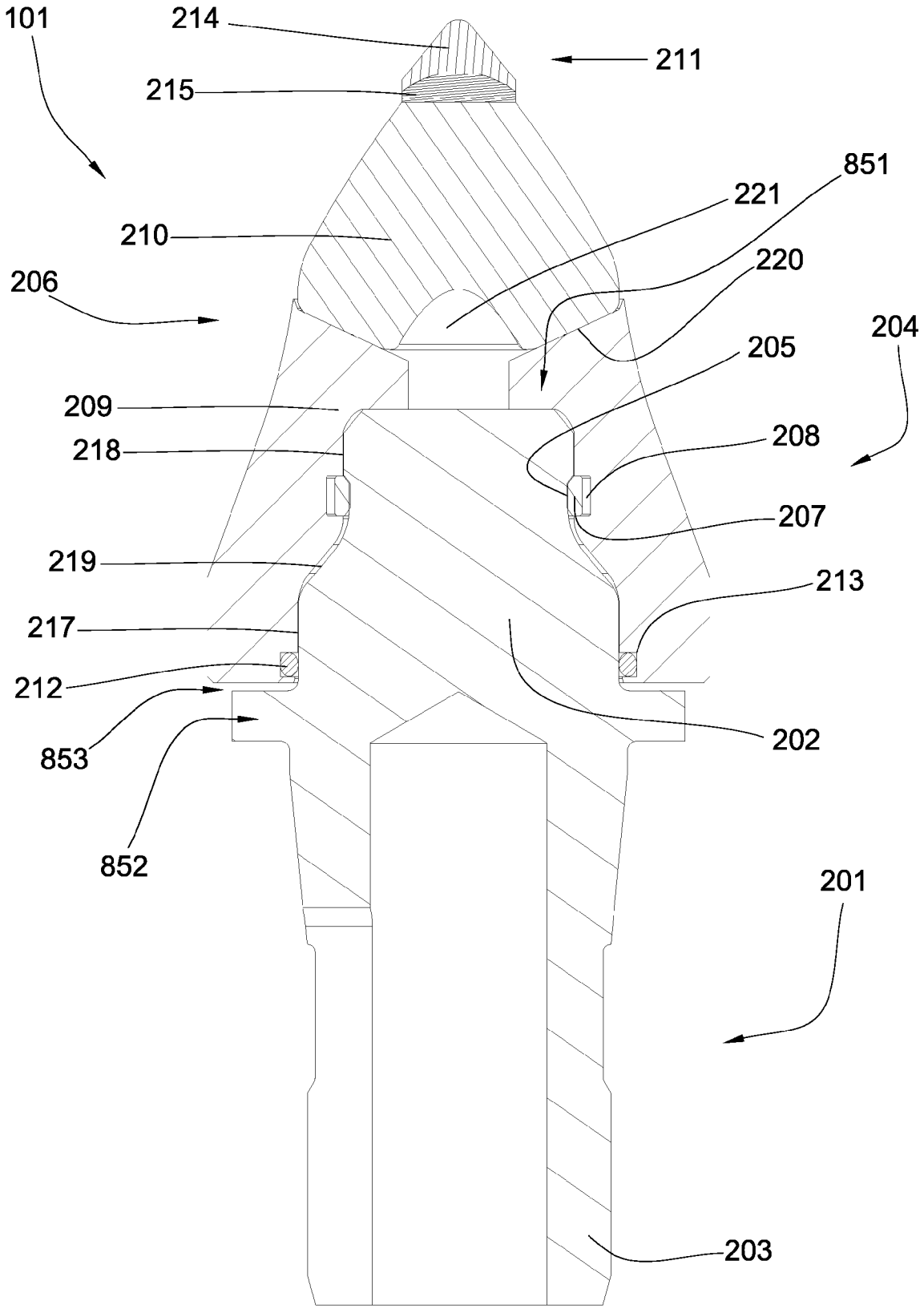
FIG. 1*a* is a cross-sectional diagram of an embodiment of a degradation assembly.

FIG. 1*a* is a cross-sectional diagram of a degradation assembly 101. Shank 201 comprises an axially forward end 202 and an axially rearward end 203. The shank may be constructed of high-strength steel. The shank 201 may be work-hardened or cold worked during manufacture to provide greater resistance to cracking or stress fractures due to the forces exerted on the degradation assembly by the formation 103 and the holder 104. The forward end 202 may comprise a plurality of bearing surfaces 204 and an annular recess 205. The plurality of bearing surfaces 204 may comprise a substantially cylindrical geometry. The plurality of bearing surfaces may comprise different diameters. The bearing surfaces may comprise a substantially conical portion. In some embodiments of the present invention, the forward end may narrow, such as through a taper or a at least one step formed in the forward end. In some embodiments of the invention, the bearing surfaces comprise a large diameter generally cylindrical bearing surface 217 and a smaller diameter generally cylindrical bearing surface 218. In some embodiments, a substantially conical portion 219 is disposed intermediate the large diameter and smaller diameter bearing surfaces. Such geometry may minimize bending, deformation, and risk of failure during use. Different diameter bearing surfaces may maximize bearing surface area with respect to the geometry of the shield. By distributing loads over a large area, the impact resistance of the shield may increase. The bearing surfaces 204 may be case hardened, in which process the bearing surface may be heated in a carbon, nitrogen, and/or boron rich environment. These elements may diffuse into the surface metal and increase the hardness, improving wear resistance. The bearing surfaces 204 may be heat treated and/or coated with a wear resistant coating such as coatings that contain chromium, nitride, aluminum, boron, titanium, carbide and combinations thereof.

A shield 206 comprising a steel portion 209, a carbide bolster 210, and an impact tip 211 is retained on the shank 201 by a retaining ring 207 which rests in the annular recess 205 and a corresponding annular recess 208 in the steel portion 209 of the shield 206. The retaining ring 207 is expandable such that it may be placed in the annular recess 208 and as the shield 206 is assembled to the shank 201, the retaining ring 207 expands radially to slide over the bearing surfaces 204 and contracts to interlock in the annular recess 205. The retaining ring 207 may be constructed of spring steel or an elastically deformable material with sufficient strength. The cross-sectional geometry of the retaining ring may be substantially rectangular, substantially circular, substantially elliptical, substantially triangular, or combinations thereof to facilitate attachment of the shield to the shank. The retaining clip may comprise a steep angle adapted to interface with the annular recess to provide sufficient resistance to pulling apart. A seal that may comprise an o-ring 212 is disposed intermediate the shank 201 and the shield 206 to prevent debris from contaminating the bearing surfaces 204 and accelerating wear. The o-ring 212 may rest in an annular recess 213 in the steel portion 209 of the shield 206 and contact the forward end 202 of the shank 201. The o-ring may be manufactured from butadiene rubber, butyl rubber, or silicone rubber. The seal may be subjected to minimal exposure on the underside of the shield as compared to other areas of the degradation assembly. The o-ring may comprise a 3 to 20 percent squeeze. Preferably the squeeze is around 10 percent.

Impact tip 211 may comprise a super hard material 214 bonded to a carbide substrate 215. The super hard material may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, coarse diamond, fine diamond, nonmetal catalyzed diamond, cemented metal carbide, chromium, titanium, aluminum, tungsten, or combinations thereof.

In some embodiments, the super hard material comprises polycrystalline diamond bonded to a carbide substrate at a non-planer interface. The carbide substrate may be less than 10 mm thick axially. The polycrystalline diamond may comprise a generally conical profile with an apex opposite the carbide substrate. The apex may comprise a radius between 0.050 inches and 0.125 inches. The thickness of the polycrystalline diamond between the carbide substrate and the apex may be greater than 0.100 inches. In some embodiments, the thickness of the polycrystalline diamond may be greater than 0.250 inches. The volume of the polycrystalline diamond may be 75%-150% of the volume of the carbide substrate, preferably 100%-150% of the volume of the carbide substrate. The carbide substrate 215 may be brazed to the carbide bolster 210, and the carbide bolster 210 may be brazed to the steel portion 209 of the shield 206.

A shield 206 comprises a steel portion 209, a carbide bolster 210, and an impact tip 211. In some embodiments, the carbide bolster 210 comprises a recess 221 formed at an interface 220 between the carbide bolster 210 and the steel portion 209 of the shield 206. The interface 220 between the carbide bolster 210 and the steel portion 209 of the shield may comprise non-planer geometry, preferably comprising a substantially conical geometry. The braze thickness may be controlled by forming protrusions in the either steel or carbide to the height of the desire braze thickness. The steel portion of the shield may comprise hard-facing to help reduce wear during operation.

Contact between the degradation assembly 101 and the formation may induce rotation of the shield 206 with respect to the shank 201. Thus, instead of concentrating the impact and abrasion on a single area of the shield, the rotation allows the impact tip, carbide bolster, and steel portion of the shield to contact the formation in different areas and wear more evenly, thus increasing the service life.

In some embodiments, the distal most surface 851 is flat and may also be a load bearing surface. The load from the tip engaging the formation may be passed thought the shield to the shank at the distal most surface, the forward portion of steps formed in the forward end, tapered portions formed in the forward end, bearing elements (not shown) such as ball bearing or roller bearings disposed between the shank and the underside of the shield. The distal most surface may comprise a wear resistant material. The material may be applied through a coating, spray, dipping or combinations thereof. The material may also be brazed, welded, bonded, chemically attached, mechanically attached or combinations thereof. The wear resistant material may comprise chromium, nitride, aluminum, boron, titanium, carbide and combinations thereof. In some embodiments, the wear resistant material may be a ceramic with a hardness greater than tungsten carbide, such as cubic boron nitride, silicon carbide, or diamond. The diamond may be vapor or physically deposited on the distal most surface. In other embodiments, the diamond may be sintered diamond which is bonded to a substrate that is bonded or mechanically attached to the distal most surface.

The shank may also comprise a radially extending flange 852 situated below the shield. A gap 853 may exist between the flange and the shield, which may allow a puller tool access to grip the shield and remove the shield. The flange may accommodate the removal of the shank.

Figure 2:
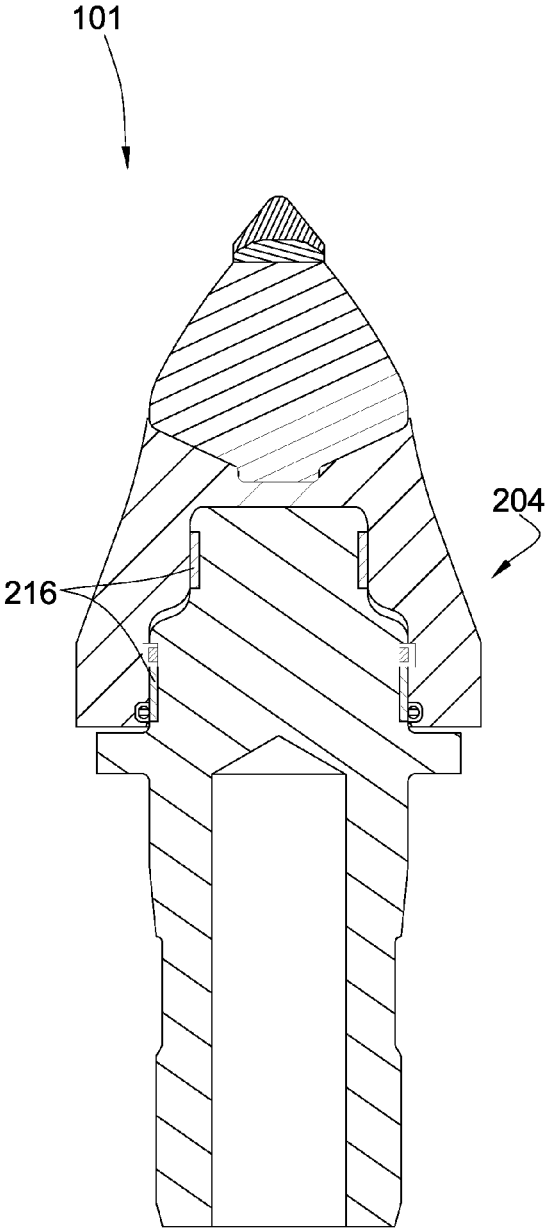
FIG. 2 is a cross-sectional diagram of another embodiment of a degradation assembly.

FIG. 2 is a cross-sectional diagram of another embodiment of a degradation assembly 101. A plurality of bearing surfaces 204 may comprise a wear-resistant material 216. The wear-resistant material 216 may comprise a cemented metal carbide, chromium, manganese, nickel, titanium, hard surfacing, diamond, cubic boron nitride, polycrystalline diamond, vapor deposited diamond, aluminum oxide, zircon, silicon carbide, whisker reinforced ceramics, diamond impregnated carbide, diamond impregnated matrix, silicon bonded diamond, brass, or combinations thereof. In some embodiments, the wear-resistant material comprises carbide inserts.

Figure 3:
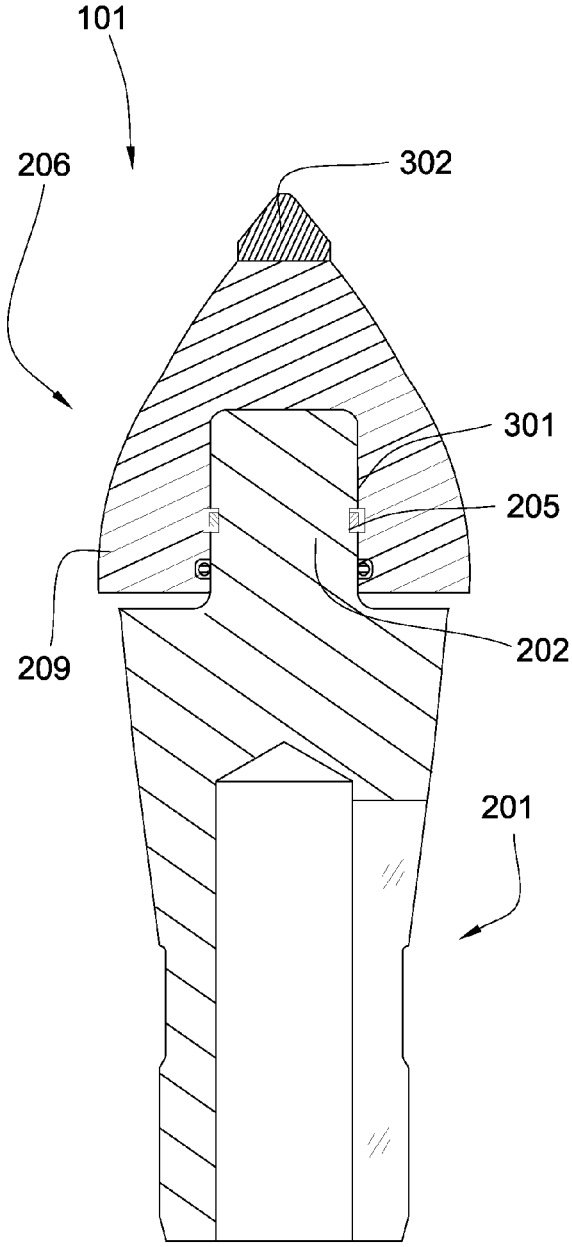
FIG. 3 is a cross-sectional diagram of another embodiment of a degradation assembly.

FIG. 3 discloses another embodiment of a degradation assembly 101. A forward end 202 of a shank 201 comprises a bearing surface 301 and an annular recess 205. The bearing surface 301 comprises a cylindrical portion of a single diameter. A shield 206 comprises a carbide impact tip 302 brazed directly to a steel portion 209.

Figure 4:
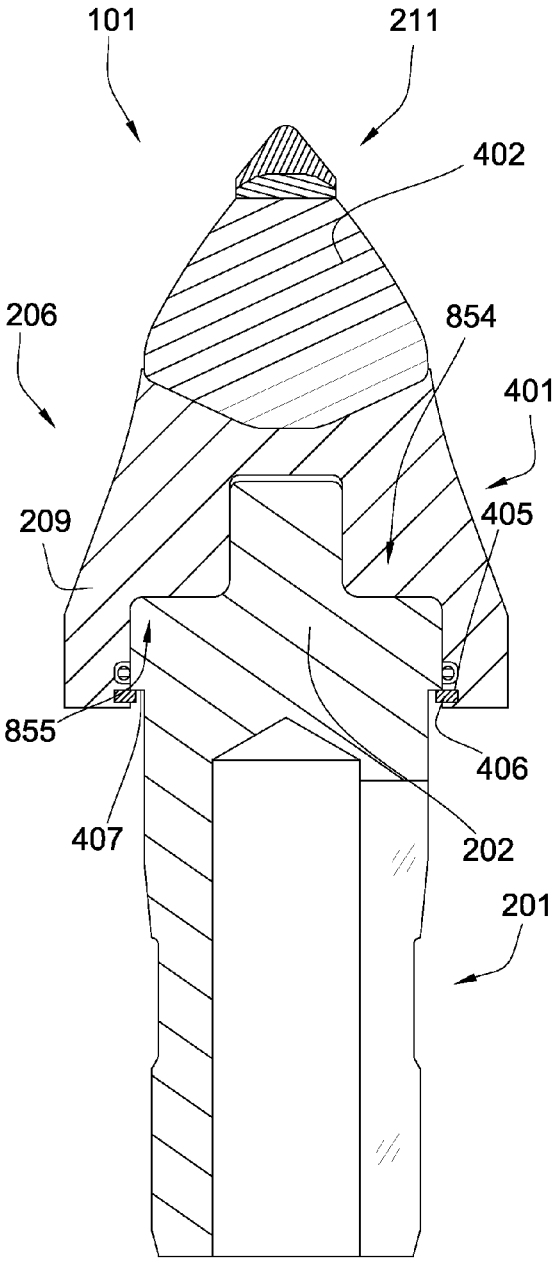
FIG. 4 is a cross-sectional diagram of another embodiment of a degradation assembly.

FIG. 4 discloses another embodiment of a degradation assembly 101. A forward end 202 of a shank 201 comprises a plurality of cylindrical bearing surfaces 401. The plurality of cylindrical bearing surfaces 401 may comprise different diameters. Shield 206 comprises an annular groove 405 adapted to accept an internal snap ring 406 or retaining ring. The snap ring 406 may abut against a shoulder 407 disposed on the forward end 202 of the shank 201 and retains the shield 206 to the shank 201. The embodiment of FIG. 4 also discloses a forward portion 854 of a step 855. The forward portion of the step may be flat or it may be round, conical or combinations thereof. In some embodiments, the forward portion of the steps are load bearing. In some embodiments the forward portions and the distal most surface are load bearing surfaces and distribute the load.

Figure 5:
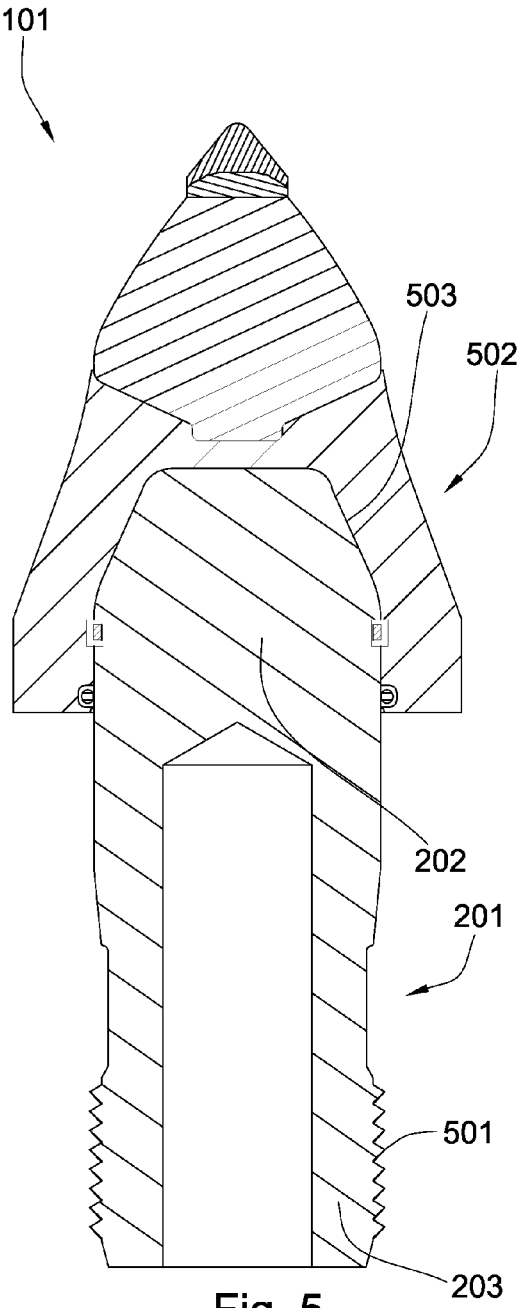
FIG. 5 is a cross-sectional diagram of another embodiment of a degradation assembly.

FIG. 5 depicts a degradation assembly 101 comprises a shank 201 with a forward end 202 and a rearward end 203. Threads 501 are disposed on the rearward end 203 of the shank 201, and are adapted for engagement into a holder attached to a driving mechanism. The forward end 202 of the shank 201 comprises a bearing surface 502 comprising a substantially conical portion 503.

Figure 6:
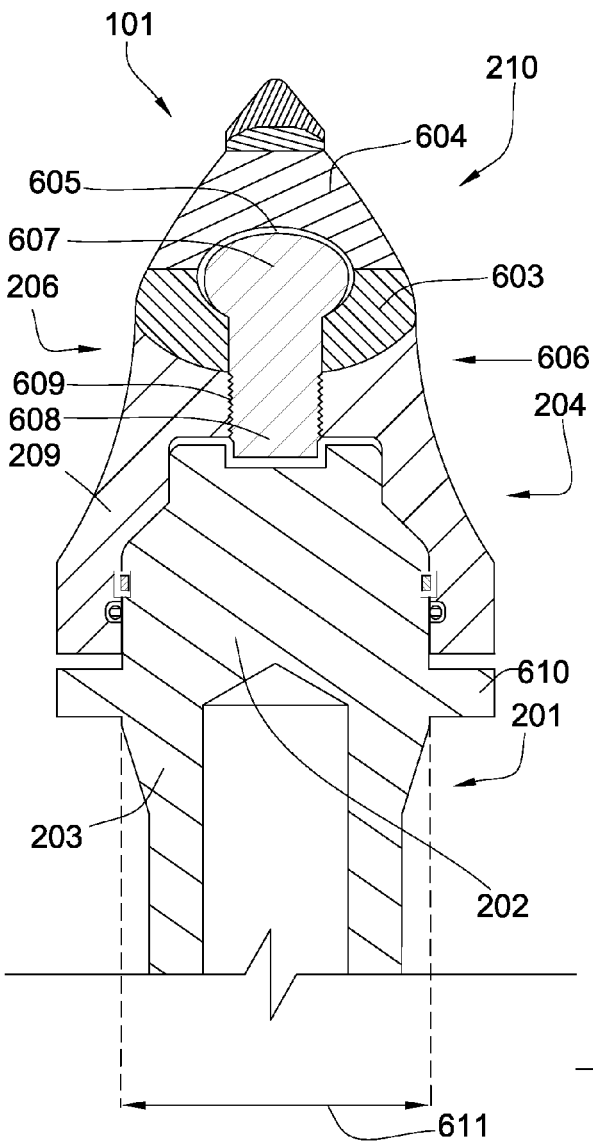
FIG. 6 is a cross-sectional diagram of another embodiment of a degradation assembly.

FIG. 6 discloses a degradation assembly 101 comprises a shield 206 with a steel portion 209. A carbide bolster 210 comprises a lower segment 603 and an upper segment 604, each segment forming at least part of a cavity 605. A shaft 606 comprises an upper end 607 and a lower end 608. The upper end 607 is interlocked in the cavity 605, and the lower end 608 is adapted to be retained in steel portion 209 by threads 609. Shank 201 comprises a flange 610 extending from the outer diameter 611 of the shank 201 disposed intermediate the forward end 202 and the rearward end 203. Flange 610 may be used to facilitate removal of shank 201 from holder 104 using a pry bar or similar device, as well as to prevent debris from contaminating the bearing surfaces 204.

Figure 7:
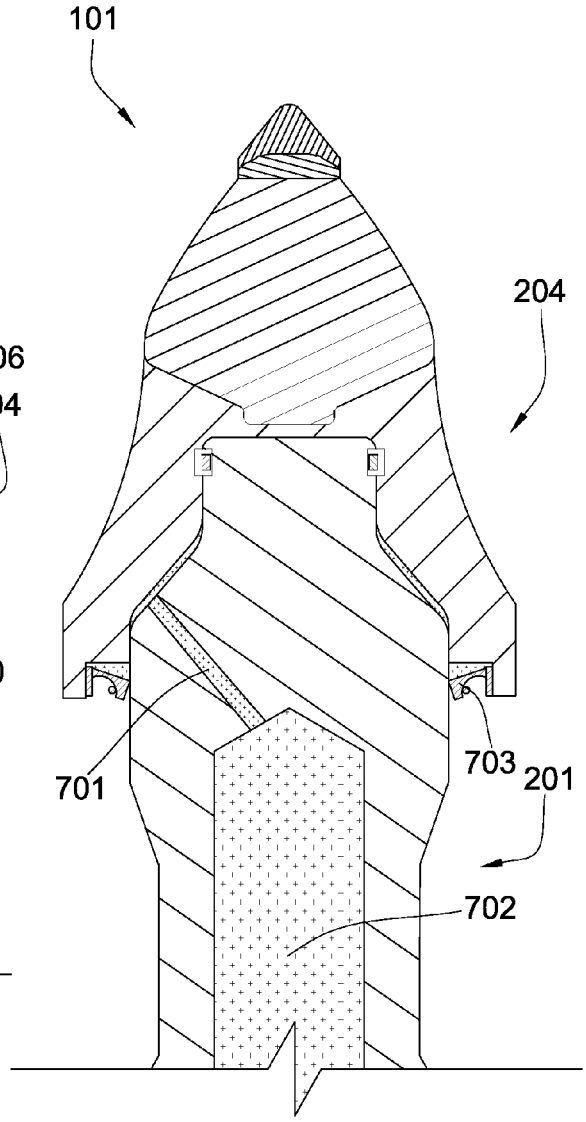
FIG. 7 is a cross-sectional diagram of another embodiment of a degradation assembly.

FIG. 7 depicts another embodiment of degradation assembly 101. Shank 201 comprises a fluid passage 701 which terminates on or near the plurality of bearing surfaces 204. Fluid 702 may be an oil or grease with lubricating properties. A seal 703 may be disposed intermediate the shank 201 and the shield 206 to retain the fluid 702 substantially on the bearing surface, and to prevent dust and debris from contaminating the fluid 702. The seal 703 may be one or more o-rings and/or a radial shaft seal. In such embodiments, a radial shaft seal may be used. Fluid 702 may be pressurized by a pump driven by the driving mechanism, a gas pressurized accumulator, a closed cell foam, an expander, a centrifugal force generated by a driving mechanism such as a rotating drum, or combinations thereof.

Figure 8:
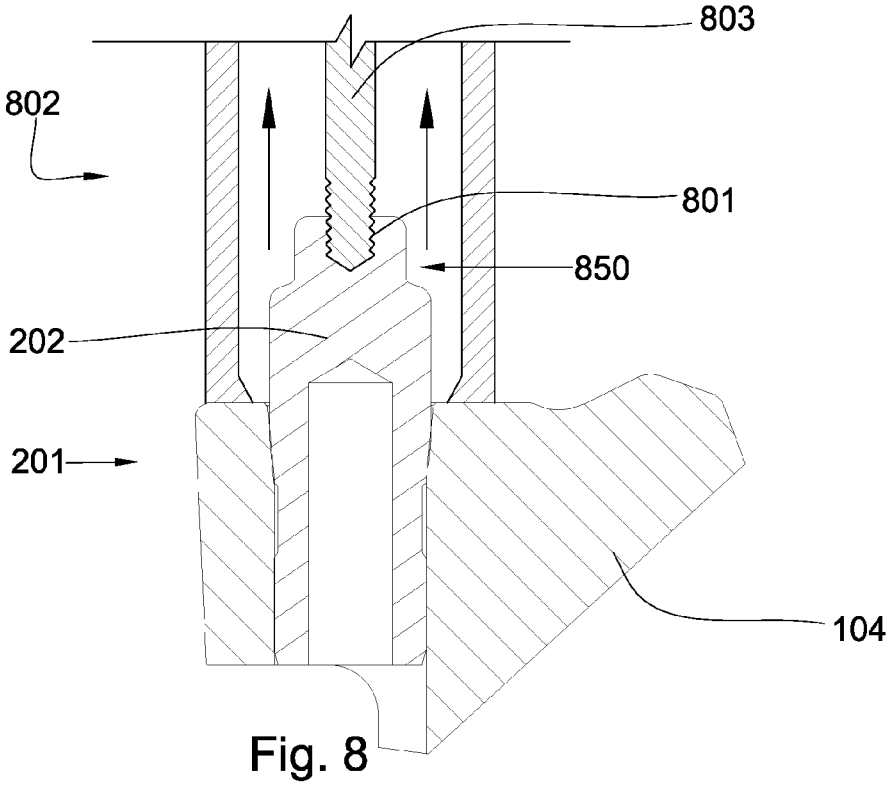
FIG. 8 is a cross-sectional diagram of an embodiment of a shank attached to a holder and a removal tool.
Figure 9:
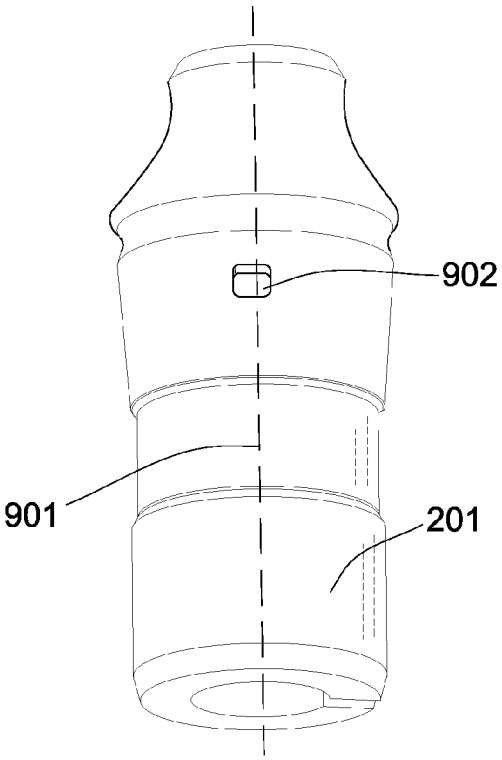
FIG. 9 is a perspective diagram of another embodiment of a shank.
Figure 10:
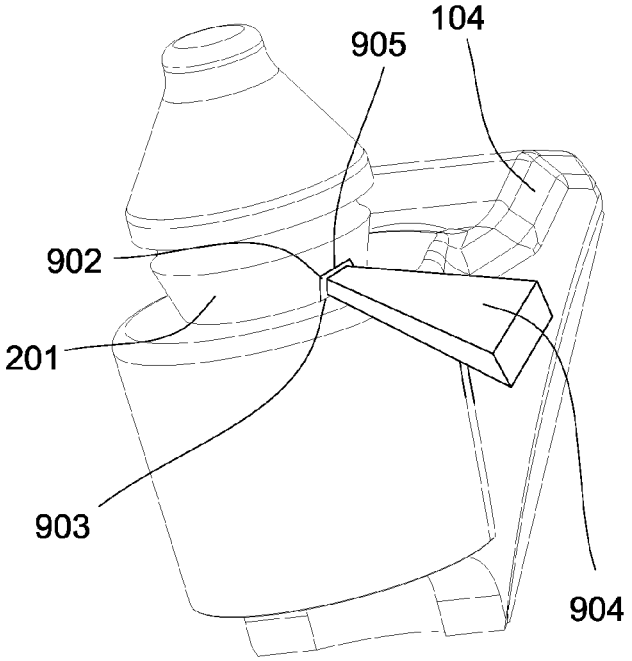
FIG. 10 is a perspective diagram of another embodiment of a shank attached to a holder and a removal tool.

An interference fit between the shank and holder may provide effective, reliable retention for the degradation assembly while providing for low manufacturing cost. The shank may be removed by hammer blows or other forces applied to the axially rearward end of the shank; however, removal of the shank may be difficult when the degradation assemblies have been in service for extended periods of time, or when the axially rearward end of the shank is not accessible from the rear of the holder. FIGS. 8, 9, and 10 disclose structures which may facilitate removal of the shank from the holder.

FIG. 8 depicts a cross section of a shank 201 attached to a holder 104. Shank 201 comprises threads 801 disposed in a hole 850 formed in the forward end 202 of the shank 201. To remove the shank 201 from the holder 104, a threaded shaft 803 of a removal mechanism 802 may be threaded into the shank threads 801 and a force applied against the holder 104. The force may be applied by mechanical, hydraulic, or other methods.

FIG. 9 discloses a shank 201 comprising a central axis 901 and a through-hole 902 disposed substantially perpendicular to the central axis 901.

FIG. 10 discloses a shank 201 attached to a holder 104. A through-hole 902 is disposed in the shank 201 such that when the shank is installed in the holder, only a part of the through-hole 902 is disposed above a top edge 903 of the holder 104. A wedge 904 may be driven into the through-hole 902, thus forcing the top edge 903 of the holder away from a top edge 905 of the through-hole 902 and loosening the shank to allow removal. The wedge may be driven into the through-hole by hammer blows or another method. The through-hole 902 may be oriented such that it is in a low stress position with respect to the forces present during operation of the driving mechanism.

Whereas the present invention has been described in particular relation to the drawings attached hereto, it should be understood that other and further modifications apart from those shown or suggested herein, may be made within the scope and spirit of the present invention.

What is claimed is:

1. A degradation assembly comprising:

a shank comprising a forward end and a rearward end, the rearward end being adapted to be retained in a holder attached to a driving mechanism;

an underside of a shield rotatably connected to the forward end of the shank; and the distal most surface of the forward end is a load bearing surface;

the shield also comprising a carbide bolster bonded to the impact tip at an end opposing the underside;

wherein the carbide bolster is disposed axially intermediate the impact tip and a steel portion of the shield along the assembly's central axis;

wherein a first and second cylindrical bearing surface on a large and smaller diameter of the forward end respectively is separated by a non-bearing, substantially conical portion of the forward end.

2. The assembly of claim 1, wherein the distal most surface comprises a flat.

3. The assembly of claim 1, wherein the distal most surface comprise a wear resistant material.

4. The assembly of claim 3, wherein the wear resistant material comprises chromium, nitride, aluminum, boron, titanium, carbide and combinations thereof.

5. The assembly of claim 1, wherein the distal most surface comprises a diamond.

6. The assembly of claim 1, wherein the distal most surface comprises ceramic with a hardness greater than tungsten carbide.

7. The assembly of claim 1, wherein the distal most surface comprise a carbide.

8. The assembly of claim 1, wherein the distal most surface is work hardened, cold hardened, or combinations thereof.

9. The assembly of claim 1, wherein the reward end is substantially cylindrical and adapted to be press fit within the holder.

10. The assembly of claim 1, wherein the shank is adapted to be rotationally stationary with respect to a driving mechanism in which the shank is secured and the shield is adapted to rotate around the shank.

11. The assembly of claim 1, wherein the forward end is tapered.

12. The assembly of claim 1, wherein the forward end comprises at least one step.

13. The assembly of claim 1, wherein the forward portion of the at least one step is also a load bearing surface.

14. The assembly of claim 1, wherein the shank comprises a radially extending flange below the shield.

15. The assembly of claim 14, wherein a gap exist between the flange and the shield, when the shield is fully connected to the forward end.

16. The assembly of claim 1, wherein a carbide bolster is attached to the shield.

17. The assembly of claim 16, wherein an impact tip is bonded to the bolster.

18. The assembly of claim 17, wherein the tip comprises a carbide substrate bonded to polycrystalline diamond.

19. The assembly of claim 18, wherein the substrate is less than 10 mm thick.

20. The assembly of claim 1, wherein the distal most surface comprises a hole.

* * * * *

UNITED STATES PATENT AND TRADEMARK OFFICE

CERTIFICATE OF CORRECTION

PATENT NO. : 7,744,164 B2
APPLICATION NO. : 12/177599
DATED : June 29, 2010
INVENTOR(S) : David R. Hall et al.

It is certified that error appears in the above-identified patent and that said Letters Patent is hereby corrected as shown below:

On the Title Page

In the left column, item (73), replace "Schluimberger" with --Schlumberger--.

Signed and Sealed this
Thirty-first Day of January, 2012

David J. Kappos

David J. Kappos
*Director of the United States Patent and Trademark Office*